United States Patent [19]

Kratz

[11] Patent Number: 4,641,226

[45] Date of Patent: Feb. 3, 1987

[54] REFLECTOR FOR LINEAR LIGHT SOURCES

[76] Inventor: Walter Kratz, Zum Schloesschen 4, D-5208 Eitorf-Muehleip, Fed. Rep. of Germany

[21] Appl. No.: 770,361

[22] Filed: Aug. 28, 1985

Related U.S. Application Data

[63] Continuation of Ser. No. 423,747, Sep. 27, 1982, abandoned.

[30] Foreign Application Priority Data

Oct. 24, 1981 [DE] Fed. Rep. of Germany ..... 3142267

[51] Int. Cl.[4] ..... F21S 3/00; F21V 7/00

[52] U.S. Cl. ..... 362/218; 362/223; 362/225; 362/241; 362/247; 362/300; 362/301; 362/307; 362/345; 362/346; 362/408

[58] Field of Search ..... 362/346, 241, 247, 225, 362/300, 301, 408, 306, 224, 218, 222, 221, 220, 345, 307, 223

[56] References Cited

U.S. PATENT DOCUMENTS

| | | | |
|---|---|---|---|
| 2,335,735 | 11/1943 | Campen | 362/225 X |
| 2,799,773 | 7/1957 | Schwartz | 362/345 X |
| 2,864,939 | 12/1958 | Bodian et al. | 362/225 X |
| 2,914,657 | 11/1959 | Akely et al. | 362/247 |
| 3,746,854 | 7/1973 | Brass | 240/41 |
| 3,829,677 | 8/1974 | Deliano | 362/346 |
| 4,388,675 | 6/1983 | Lewin | 362/346 X |

FOREIGN PATENT DOCUMENTS

| | | | |
|---|---|---|---|
| 2833010 | 8/1979 | Fed. Rep. of Germany | 362/346 |
| 1095363 | 12/1954 | France | 362/225 |

*Primary Examiner*—Deborah L. Kyle
*Assistant Examiner*—John S. Maples
*Attorney, Agent, or Firm*—Fleit, Jacobson, Cohn & Price

[57] ABSTRACT

A reflector for linear light sources and particularly for fluorescent tubes. The reflector has a substantially V-shaped cross-sectional configuration. For use in an array of lamps comprising a plurality of light sources arranged in parallel, a plurality of reflectors of the type disclosed may be assembled to form a reflector arrangement corresponding in size to the array of lamps, with the assembly in its entirety being sawtooth-shaped in cross-section.

19 Claims, 4 Drawing Figures

REFLECTOR FOR LINEAR LIGHT SOURCES

This is a continuation of application Ser. No. 423,747 filed Sept. 27, 1982 now abandoned.

The instant invention relates to a reflector having a substantially V-shaped cross-sectional configuration to be used for a linear light source and particularly for a fluorescent tube.

Reflectors of this type have been known by U.S. Pat. No. 3,746,854. Similar reflectors of which the cross-sectional shape is at least basically V-shaped have been known by German Pat. No. 743,499.

The object underlying the instant invention is to provide a reflector of the type specified above which is easy to manufacture and to install and which will enable high radiant efficiencies to be obtained particularly where a plurality of linear light sources is assembled to form an array of lamps.

For achieving this object, the invention includes for an array of light sources comprising a plurality of light sources assembled in a parallel side-by-side relationship in a plane perpendicular to the main radiation exit opening, a plurality of reflectors corresponding in number to said given plurality of light sources each reflector having angularly disposed first and second rectangular sheets including long edges and short edges and being connected along adjacent long edges thereof, and being assembled to form an integral reflector panel, with adjacent reflectors being joined along the edges formed by the free ends of the legs of the V-shaped cross-sectional shape of the reflectors, and with the reflector panel being sawtooth-shaped in cross section.

In an advantageous further development of the subject matter of this application, the sawtooth arrangement comprises alternating relatively gently and steeply sloped side surfaces, respectively. Preferrably, the relatively gently sloped side surfaces include with the main radiation exit direction an angle of about 50° to 70°; more preferrably, the aforesaid angle is about 60°.

Also, the relatively steeply sloped side surfaces may include with the main radiation exit direction an angle of about 20° to 40°; most advantageous results have been obtained with an arrangement in which the aforesaid angle is about 30°.

A particularly high luminous efficiency will be obtained by a most preferred embodiment of the subject matter of the instant invention in which the sloped side surfaces of the teeth in the sawtooth arrangement have lengths such that the lines generated by perpendicular parallel projection of the sloped side surfaces in a projection plane perpendicular to the main radiation exit direction have in that plane a projected length corresponding to the diameter of a light source or the spacing between adjacent light sources, respectively and coincident therewith. Where the reflector configuration is adapted to the associated array of lamps in this manner, a particularly great portion of the radiation the light sources radiate rearwardly, i.e. towards the reflector, will be returned by the reflector towards the radiation exit opening. Even if adjacent light sources are relatively closely spaced, a very great portion of the radiation radiated towards the reflector will be deflected in the desired direction to be utilized by the user.

A particularly great portion of the rearwardly directed radiation will be deflected to be utilized by the user in case the angle between adjacent sloped side surfaces is approximately 90°. A configuration of this type will cause that portion of the radiation to be deflected completely which the light source radiates in a direction opposite to the main radiation exit direction, whereby that portion of the radiation may be utilized.

Of course, any point on the glass envelope of a linear light source such as a fluorescent tube will radiate in every direction so that it would be relatively difficult to trace and describe all possible bundles of rays by the methods of geometric optics.

Practical experience with the inventive reflector has shown, however, that surprisingly high radiant efficiencies may be obtained.

Also, the inventive reflector is advantageous in that it may be provided in any desired width, i.e. comprising virtually any number of individual reflectors, whereby it is easy and economic to fabricate and to assemble.

Also, virtually any highly reflective material may be used for fabricating the inventive reflector, and any current and known fabricating method, including deep drawing, may be applied without problems for making the inventive reflector.

Where the inventive reflector is made preferably by deep-drawing a lightweight plastics material into a sheet having a reflective coating thereon, the resultant weight will be particularly low while the stability and strength properties will be excellent consistently.

According to another advantageous further development of the inventive reflector, openings are provided at selective locations in the reflector panel to furnish cooling air to the light sources. Preferably, these openings are in the form of elongated narrow slots in a portion of the reflectors in which a light source will be projected by perpendicular projection in a direction opposite to the main radiation exit direction. As a result, excellent ventilation of an array of lamps will be obtained, also the ventilation openings will be invisible, practically, because they are concealed by the linear light sources. This way, the arrangement will produce a most advantageous opto-aesthetical impression.

The slots are easy to cut in and are conveniently arranged behind the linear light sources if the slots are substantially rectangular in shape.

To obtain particularly efficient ventilation characteristics, the arrangement may be such that the openings are provided in pairs in close proximity to a ridge formed between two adjoining sloped surfaces in the reflector panel.

In many cases it is desirable to dispose in front of an array of lamps, i.e. in the area of the radiation exit opening, a protective cover or panel as transmissive as possible to the radiation emitted. A cover or panel of this type may be subject to substantial strain. In order to ensure proper retention of such protective cover or panel, the invention provides for sturdy supporting fins or webs between groups comprising a selective number of reflectors, said webs being positioned in the area of the ridge between two adjoining sloped surfaces and pointing towards the light sources to project from the reflector panel beyond the light sources in the main radiation exit direction. Preferably the supporting web is in the shape of an extremely narrow and steeply sloped ridge or ridge roof and has a prong-like cross-sectional shape.

Being positioned between the individual light sources of an array of lamps, the supporting web does not create any disturbance, yet ensures excellent stability where the angle included by the two legs of the cross-sectional prong shape of the supporting web at the tip thereof is less than 10°. Preferably the angle at the tip of the prong is about 5°.

The stability and, particularly, the strength of the supporting web may be enhanced by providing on both sides thereof an outwardly projecting rib at the height of the ridge and by causing the edge of the sloped side surface adjacent the supporting web to begin right underneath that rib (FIG. 2). This way, the edge portion of a reflector panel may advantageously be maintained in a well-defined position; in addition, that edge portion will provide lateral support to the supporting web where the edge of the sloped side surface is seated under the rib in an interference fit.

A relatively strong supporting action for a protective cover or panel is obtained where three to five reflectors are arranged between any two supporting webs.

It should be noted that the distance between adjacent supporting webs and, thus, the number of reflectors provided between any two supporting webs may be adapted to the loading conditions extant.

The invention will now be described by way of an embodiment example under reference to the appended drawings, in which FIG. 1 is a schematic cross-sectional view of a portion of an array of lamps having mounted therebehind a reflector arrangement according to the invention;

Figure 1:
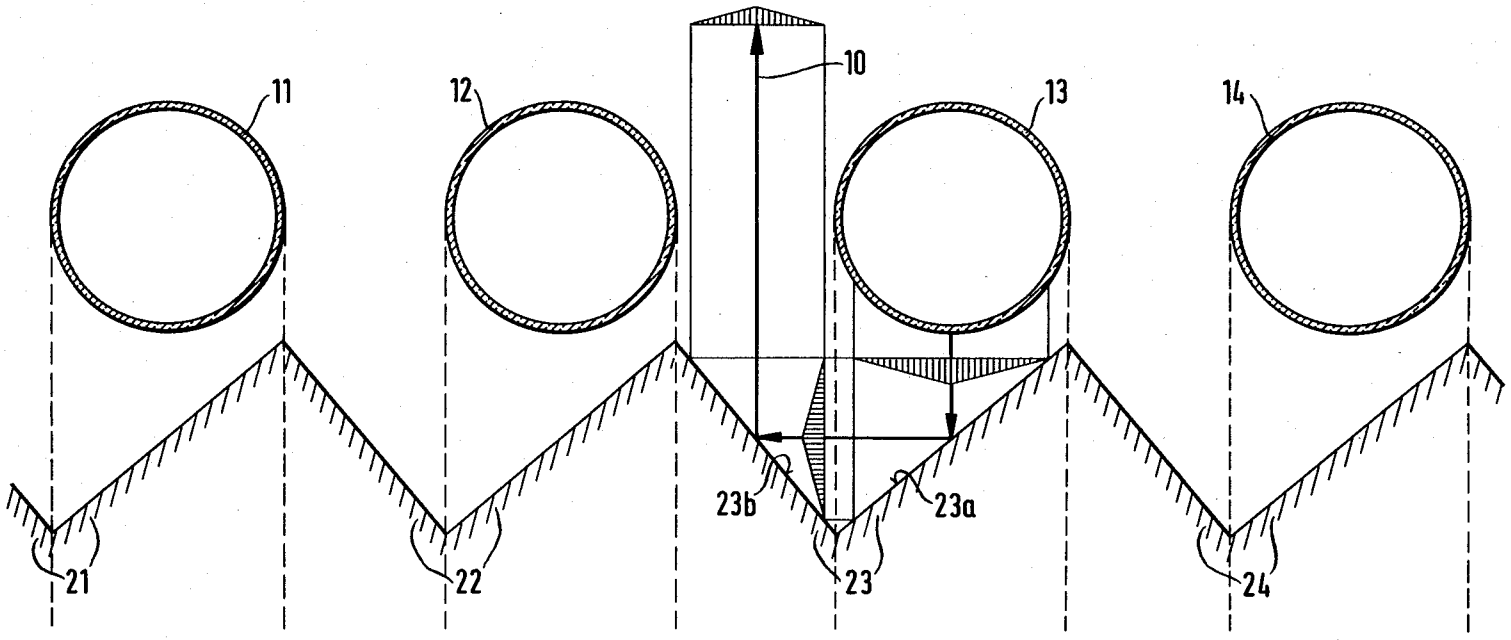

As shown in FIG. 1, light sources 11, 12, 13 and 14 in the form of fluorescent tubes are shown schematically in cross section; these lamps may be part of a larger array of lamps. In FIG. 1, the section plane extends at right angles to the longitudinal axes of the light sources.

A reflector 21, 22, 23 and 24 is disposed behind each light source 11, 12, 13, 14, respectively.

According to FIG. 1, the two legs of a V-shaped reflector include a right angle. Reflectors 21 to 24 serve to deflect and guide throughbetween the light sources as great a portion as possible of the radiation emitted towards the reflectors. In general, it may be assumed that each one of light sources 11 to 14 radiates from any point of its surface. For example, FIG. 1 shows for light source 13 a bundle of rays the light source emits in a direction opposite to the main radiation exit direction shown at 10. This bundle of rays strikes reflector surface 23*a* of V-shaped reflector 23, is reflected on reflector surface 23*b* and, after another reflection at reflector surface 23*b*, will propagate throughbetween the two light sources 12 and 13 in main radiation exit direction 10, i.e., the direction in which light sources 11 to 14 are supposed to radiate to as great an extent as possible. Thus, in FIG. 1, it is assumed in the pictorial representation that as great a portion of the radiation generated by light sources 11 to 14 is radiated upwardly, i.e. in main radiation exit direction 10.

Unavoidably, a portion of the radiation radiated downwardly in FIG. 1 will not be deflected in the desired direction and will be lost. However, the invention seeks to provide a reflector both simple and inexpensive which deflects in the main radiation exit direction as great a portion of the radiation radiated by light sources 11 to 14 even if the diameters of the light sources and the distances between adjacent light sources differ substantially.

Apart from the bundle of rays shown in FIG. 1, light source 13 will radiate in almost any downward direction, i.e. generally towards the reflector arrangement, which radiation will not be reflected as described above and as shown for the bundle of rays depicted in FIG. 1. The drawing shows, however, that at least those rays will be deflected completely in main radiation exit direction 10 which the light source radiates in a direction directly opposite thereto.

As shown in FIG. 1, the area below each one of light sources 11 to 14 is bounded by relatively gently sloped side surfaces of a sawtooth arrangement. In other words, and assuming vertical parallel projection in a direction opposite to main radiation exit direction 10, the full cross-section area of a light source such as 13 will be projected on reflector surface 23*a* therebelow, and again assuming such projection, the space between two light sources 12 and 13 will be projected on reflector surface 23*b*.

It would be possible, generally, to provide behind light sources 11 to 14 the more steeply sloped side surfaces of the sawtooth reflector arrangement so that the relatively gently sloped side surfaces of the sawtooth arrangement would underlie the spaces between the light sources. An arrangement of this type would be advantageous, for example, where the spaces between adjacent light sources are wider than the diameters of the light sources.

Figure 4:
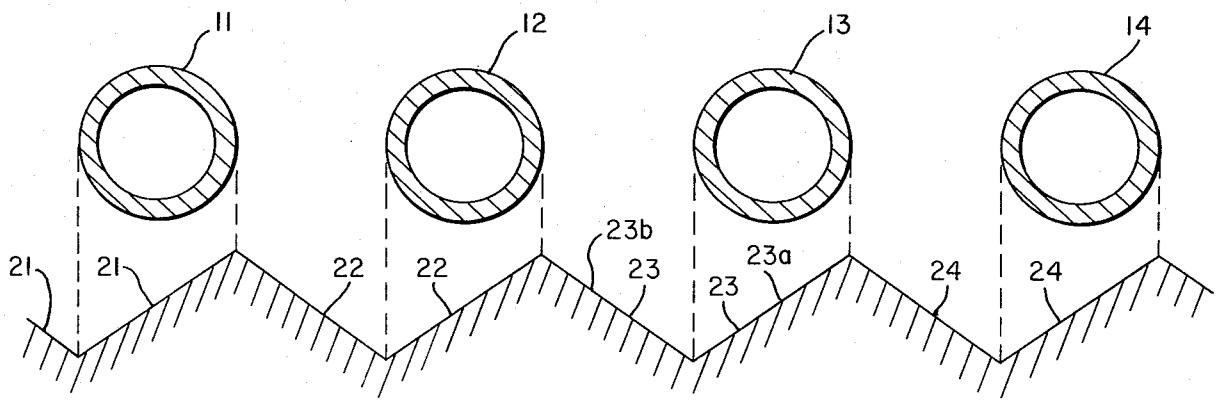
FIG. 4 is a schematic cross-sectional view similar to FIG. 1 and in which the spacing between adjacent light sources is equal to the diameter of the light sources.

If in a particular arrangement of an array of lamps the individual lamps have diameters equal to the distances between them, as illustrated in FIG. 4, the reflector arrangement may be selected such that the V-shaped reflectors are symmetrical in cross-section, instead of asymmetrical as shown in FIG. 1.

According to the invention, and as shown in FIG. 1, the arrangement preferably is such that a straight line commonly tangent to the bottoms of light sources 11 to 14 in FIG. 1 extends just above the highest points of the sawtooth reflector arrangement. If the spacing between the plane of an array of lamps and the plane of a reflector panel is minimum in this sense or slightly greater, the obtainable radiant efficiency will be particularly favorable. However, satisfactory results will be obtained generally if the asymmetry of the light sources with respect to the reflectors is less than shown in FIG. 1. If, for example, the light source centers are approximately higher than the peaks of the V-shaped reflectors so that the arrangement of the light sources relative to the reflectors is substantially symmetrical, the inventive structure will in general provide a most favorable radiant efficiency, and this even where the surface of the light sources is relatively near and substantially nearer to the reflectors than shown in FIG. 1.

It has been found in practical applications of the inventive reflector arrangement that in any case a surprisingly great portion of the radiation emitted towards the reflector will be deflected in the desired direction for utilization. In each individual case, the optimum geometry may be determined relatively easily and quickly experimentally varying the parameters described above.

It is possible, of course, to join adjacent reflectors 21 to 24 by rounded transition instead of the sharp corners shown in FIG. 1. Correspondingly, the apex of each individual reflector may be rounded instead of peaked.

Figure 2:
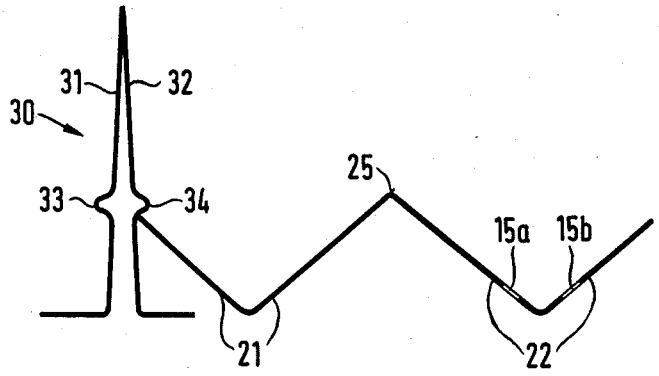
FIG. 2 is a partial sectional view taken through a supporting web engaging one edge of a reflector panel.

In a sectional view similar to FIG. 1, FIG. 2 shows two reflectors 21 and 22 joined along a ridge 25. One of the legs of reflector 21 adjoins a supporting web 30 mounted on holding means (not shown) which may be used generally for supporting reflectors 21 and 22 as well. Supporting web 30 is prong-like in cross-sectional shape as defined by two surfaces converging at a very acute angle, with said surfaces forming the side surfaces or slopes of the prong-like supporting web 30 and merging into each other at the tip thereof. The angle included by the side surfaces at the peak of the prong-like supporting web is smaller than 10° and on the order of about 5°.

Outwardly protruding ribs 33 and 34 are formed on each one of the two steeply inclined side surfaces forming the slopes of the prong-like supporting web and converging at the peak. The two ribs 33 and 34 provided on the two legs 31 and 32 of the prong-section supporting web 30 are provided at approximately the height of ridge 24 interconnecting two adjacent reflectors 21 and 22, as shown in FIG. 2. As shown in FIG. 2, rib 34 not only enhances the buckling strength of supporting web 30, as does rib 33. In addition, it serves as means for retaining the lefthand free end of reflector 21. This free outer end of reflector 21 adjacent supporting web 30 may be placed underneath rib 34 in an interference fit so that the reflector will be fixed in position. At the same time, the additional bracing action will contribute to the stability of supporting web 30.

Where supporting webs such as 30 are provided at some interval, a protective cover or panel may be placed on these supporting webs in order to protect the light sources (not shown in FIG. 2) from environmental conditions or loading. At the same time, a cover of this kind may serve to define between the reflector arrangement and the cover a cooling duct through which cooling air may be forced to cool the light sources. Of course, the material of a protective cover or panel of this type must be selected to be transmissive of at least the desired portion of the spectrum the light sources radiate.

It may be useful to provide in the reflectors openings for forcing cooling air therethrough. In FIG. 2, openings of this kind are shown in 15*a* and 15*b* in reflector 22, for example. As shown in FIG. 2, the two openings 15*a*, 15*b* are provided in close proximity to the apex of V-shaped reflector 22. If in an embodiment of this type a light source is positioned to have its center substantially above the apex of the reflector, the light source, such as a fluorescent tube, will cover openings 15*a* and 15*b* at least broadly enough for them not to be easily visible.

Figure 3:
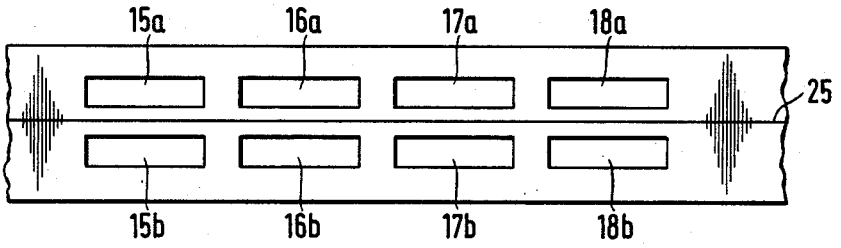
FIG. 3 is a plan view of a reflector and shows ventilating slots.

As shown in FIG. 3, a series of openings 15*a*, 15*b*; 16*a*, 16*b*; 17*a*, 17*b*; 18*a*, 18*b* may be provided in pairs along a ridge 25 of a reflector to provide for the passage of adequate amounts of cooling air. This kind of an arrangement, in which these openings are in the form of rectangular slots disposed in pairs symmetrical with respect to ridge 25, is most advantageous where, as described above, a light source is positioned symmetrically with respect to the V-shaped configuration of a reflector.

In an arrangement as shown in FIG. 1, for example, ventilating slots (not shown) may of course be provided in reflectors 21 to 24 below the respective light sources 11 to 14.

Desirably, the area of the ventilating slots is minimized to lose as little as possible of the reflective surface area.

For this reason, ventilating slots may be provided by cutting openings into the reflector surfaces at a few locations only and by raising the areas adjacent the cutting lines in the manner of louvres. As a ventilating arrangement of this type involves practically no removal of material from the reflective surface, virtually no useable reflecting surface will be lost even in the area of these ventilating openings.

What is claimed is:

1. In an array of linear light sources including a plurality of tubular light sources placed in a parallel, equally spaced-apart relationship with respect to one another and extending in a plane perpendicular to a main radiation exit direction of said array, an integral reflector panel for use adjacent to said array and spaced apart therefrom to thereby achieve a high radiant efficiency in the main radiation exit direction, said panel having a sawtooth-shaped cross-section and comprising:

a plurality of reflectors corresponding in number to the number of said plurality of tubular light sources, each reflector having angularly disposed first and second rectangular sheets including long edges and short edges and being connected along adjacent long edges thereof, adjacent reflectors being joined along adjacent long edges thereof to thereby form the sawtooth-shaped cross-section of the integral reflector panel, wherein the angularly disposed first and second sheets of each reflector each have a slope, provided that the slope of the first sheet is less than the slope of the second sheet, and wherein each second sheet includes with the main radiation exit direction an angle of 20° to 40°, wherein projection lines drawn parallel to the main radiation exit direction from the extremities of the short edges of each of the first sheets onto a plane through the centers of the plurality of light sources define a projected length which is substantially equal to the diameter of one light source and which is coincident with the extremities of the diameter of the light source, and wherein projection lines drawn parallel to the main radiation exit direction from the extremities of the short edges of each of the second sheets onto a plane through the centers of the plurality of light sources define a projected length which is substantially equal to the spacing between the extremities of adjacent light sources and which is coincident therewith.

2. An integral reflector panel according to claim 1, wherein the included angle is 30°.

3. An integral reflector panel according to claim 1, wherein the angularly disposed first and second sheets of each reflector each have a slope, provided that the slope of the first sheet is less than the slope of the second sheet.

4. An integral reflector panel according to claim 3, wherein each first sheet includes with the main radiation exit direction an angle of 50° to 70°.

5. An integral reflector panel according to claim 4, wherein the included angle is 60°.

6. An integral reflector panel according to claim 1, wherein the panel further comprises openings provided therethrough to allow for the passage of cooling air.

7. An integral reflector panel according to claim 6, wherein the openings are in the form of elongated narrow slots provided in the area of the panel onto which light will be imaged by parallel projection in a direction opposite to the main radiation exit direction.

8. An integral reflector panel according to claim 7, wherein said slots are substantially rectangular in shape.

9. An integral reflector panel according to claim 6, wherein the openings are provided in pairs in close proximity to a ridge defined by the joining of adjacent reflectors along adjacent long edges thereof.

10. An integral reflector panel according to claim 9, wherein said openings are a series of pairs of openings arranged in line with one another in a closely spaced relationship.

11. An integral reflector panel according to claim 1, wherein the panel further comprises a plurality of sturdy supporting webs for supporting a protective cover disposed adjacent the array of lamps on the side thereof opposite the reflector panel, which protective cover is transmissive to radiation emitted in use by the light sources, and which supporting webs project outwardly from the panel in the direction of the main radiation exit direction, extend beyond the light sources, and are each located near a ridge defined by the joining of adjacent reflectors along adjacent long edges thereof.

12. An integral reflector panel according to claim 11, wherein the supporting web is in the form of an extremely narrow and steeply sloped ridge roof having two legs and is prong-like in cross-section.

13. An integral reflector panel according to claim 12, wherein the angle included by the two legs of the ridge roof of the support web is less than 10°.

14. An integral reflector panel according to claim 13, wherein the included angle is 5°.

15. An integral reflector panel according to claim 11, wherein the plurality of supporting webs each further comprise a pair of outwardly projecting ribs positioned one on each side thereof and wherein the long edges of reflectors adjacent to each supporting web are each placed adjacent to and underneath one of the ribs.

16. An integral reflector panel according to claim 15, wherein the placement of each adjacent long edge is made with a slight interference fit.

17. An integral reflector panel according to claim 11, wherein from three to five reflectors are provided between any two supporting webs.

18. In an array of linear light sources including a plurality of tubular light sources placed in a parallel, equally spaced-apart relationship with respect to one another and extending in a plane perpendicular to a main radiation exit direction of said array, an integral reflector panel for use adjacent to said array and spaced apart therefrom to thereby achieve a high radiant efficiency in the main radiation exit direction, said panel having a sawtooth-shaped cross-section and comprising:

a plurality of reflectors corresponding in number to the number of said plurality of tubular light sources, each reflector having angularly disposed first and second rectangular sheets including long edges and short edges and being connected along adjacent long edges thereof, adjacent reflectors being joined along adjacent long edges thereof to thereby form the sawtooth-shaped cross-section of the integral reflector panel, wherein projection lines drawn parallel to the main radiation exit direction from the extremities of the short edges of each of the first sheets onto a plane through the centers of the plurality of light sources define a projected length which is substantially equal to the diameter of one light source and which is coincident with the extremities of the diameter of the light source, wherein projection lines drawn parallel to the main radiation exit direction from the extremities of the short edges of each of the second sheets onto a plane through the centers of the plurality of light sources define a projected length which is substantially equal to the spacing between the extremities of adjacent light sources and which is coincident therewith, and wherein the angle included between the angularly disposed first and second sheets of each reflector is a right angle.

19. In an array of linear light sources including a plurality of identical tubular light sources placed in a parallel, equally spaced-apart relationship with respect to one another and having their axes extending in a plane perpendicular to a main radiation exit direction of said array, wherein the spacing between adjacent light sources in said plane is equal to the diameter of the light sources, an integral reflector panel for use adjacent to said array and spaced apart therefrom to thereby achieve a high radiant efficiency in the main radiation exit direction, said panel having a sawtooth-shaped cross-section and comprising:

a plurality of reflectors corresponding in number to the number of said plurality of tubular sources, each reflector having angularly disposed first and second rectangular sheets including long edges and short edges and being connected along adjacent ling edges thereof to define an angular reflector having an inner apex at the connection of said adjacent long edges, adjacent reflectors being joined along free long edges thereof to define a plurality of spaced outer apices to thereby form the sawtooth-shaped cross-section of the integral reflector panel, wherein projection lines drawn parallel to the main radiation exit direction from the extremities of the short edges of each of the first sheets onto a plane passing through the centers of the plurality of light sources are spaced from each other and the spacing therebetween defines a projected length in said plane which is substantially equal to the diameter of one light source and which projection lines are substantially coincident with the extremities of the diameter of the one light source, wherein projection lines drawn parallel to the main radiation exit direction from the extremities of the short edges of each of the second sheets onto a plane passing through the centers of the plurality of light sources are spaced from each other and the spacing therebetween defines a projected length in said plane which is substantially equal to the spacing between opposed extremities of adjacent light sources and which projection lines are substantially coincident with the opposed extremities of the adjacent light sources, said light sources lying opposite said first sheets and between said inner and outer apices when viewed in the main radiation exit direction, and wherein the short edges of the first and second rectangular sheets have the same lengths.

* * * * *